United States Patent [19]

Moore et al.

[11] 4,283,881

[45] Aug. 18, 1981

[54] CASEMENT WINDOW SECURITY GUARD

[76] Inventors: Charles E. Moore, 4426 Manner Dale Dr., Louisville, Ky. 40220; Donald K. Moore, 6922 Peppermill La., Louisville, Ky. 40228; James M. Moore, 5109 Braidwood Dr., Louisville, Ky. 40219

[21] Appl. No.: 156,724

[22] Filed: Jun. 5, 1980

[51] Int. Cl.[3] ..... E05B 65/00; E06B 3/68

[52] U.S. Cl. ..... 49/35; 49/57; 49/394; 49/503

[58] Field of Search ..... 49/57, 35, 50, 56, 67, 49/394, 503

[56] References Cited

U.S. PATENT DOCUMENTS

| | | | |
|---|---|---|---|
| Re. 19,617 | 6/1935 | Dresser | 49/35 |
| 1,550,404 | 8/1925 | Vincent | 49/57 |
| 1,954,559 | 4/1934 | Crandall | 49/57 X |
| 2,214,884 | 9/1940 | Kistner | 49/35 X |
| 2,222,667 | 11/1940 | Kitzelman | 49/57 |
| 3,340,661 | 9/1967 | Krieger | 49/57 X |
| 4,059,923 | 11/1977 | Sauer | 49/57 |
| 4,162,590 | 7/1979 | Earley | 49/57 X |

*Primary Examiner*—Philip C. Kannan
*Attorney, Agent, or Firm*—Francis H. Boos

[57] ABSTRACT

A security guard for mounting to a frame of a window opening in a building includes an elongated channel bar having a plurality of mounting pins secured to one end thereof and a key actuated lock visible and operable only from the interior of the building mounted within the confined flanged area of the bar at the opposite end thereof, the mounting pins and the retractable dead bolt of the lock cooperative with adjacent window frame structure to securely but releasably retain the channel bar in position next to the window on the interior side thereof. The spaced pins prohibit the bar from being rotated and an additional lock cover member mounted to the bar substantially coextensive of the lock protects the lock from external tampering. Suitable grill work or the like may be mounted to and supported by the channel bar.

7 Claims, 5 Drawing Figures

CASEMENT WINDOW SECURITY GUARD

BACKGROUND OF THE INVENTION

This invention relates generally to security devices and specifically to an anti-burglar apparatus suitable for mounting in a casement window or the like.

The rapid increase in burglaries, and particularly residential burglaries, in recent years has created an increased need and demand for an economical yet effective means for burglar-proofing conventional windows. It is, of course, well known to burglar-proof windows by providing a grill work of metal bars, expanded metal, or ornamental grill design which are rigidly mounted in position covering the window. However, these prior art devices suffer the serious drawback that they prevent passage equally as well from the inside as the outside, and, therefore, present a serious hazard in the case of fire. Further, these rigidly mounted prior art devices have presented serious obstructions to window washing, routine maintenance, painting, and the like.

Less complicated anti-burglar apparatus is also shown having sturdy construction through use of channel irons such as shown in U.S. Pat. No. 4,162,590; however, these devices are not easily removable and, therefore, suffer from the drawbacks noted above.

It is also known to provide complete covers having an integral frame adapted to fit a conventional window and including a plurality of key actuated locks each having a bolt adapted to project into a keeper slot in the frame structure as taught in U.S. Pat. No. 4,059,923. These devices tend to be relatively expensive and time consuming to install due to their extensive structure, and the positioning of the lock does not render these devices substantially tamper proof.

Other key actuated removable window guards are known such as taught by U.S. Pat. Nos. 1,550,404; 1,954,559 and Re. 19,617, however, each of these positions the locks where they may be tampered with such as by hammering and located so as to be easily picked.

Thus, there is a need for a window security guard which is adaptable to mounting in a variety of window frames such as casement window bucks having small but significant variations in frame dimensions; which is strong and durable yet economical to manufacture and easily and quickly installed; and which allows for easy removal by means of a key actuated lock but which safeguards the lock mechanism from tampering or destruction.

SUMMARY OF THE INVENTION

The foregoing and other deficiencies of the prior art devices are overcome by the present invention which provides a security guard for a window having opposed frame members mounted in a building structure wherein the guard comprises an elongated channel member constructed and arranged to fit within the window between the opposed frame member with a confined flanged area facing inwardly of the building. Mounting means are fixedly secured to and extend from one end of the channel member and are adapted to engage complementary recess means formed in one of the opposed frame members. Key actuated lock means are fixedly secured within the confined flanged area of the channel member at the other end thereof, the lock means having a retractable bolt adapted to extend from the end of the channel member into a complementry recess formed in the other of the opposed frame members. Lock cover means are fixedly secured to the channel member substantially coextensive of the lock means, the cover being constructed and arranged to envelope the lock means within the confined flanged area of the channel member. Suitable grill work may be mounted to and supported by the channel bar.

BRIEF DESCRIPTION OF THE DRAWINGS

The novel features which are believed to be the substance of the invention are set forth with particularity in the appended claims. The invention itself, both as to organization and method of operation, together with further objects and advantages may best be understood by reference to the following description taken in connection with the accompanying drawing in which:

DESCRIPTION OF THE PREFERRED EMBODIMENT

Figure 1:
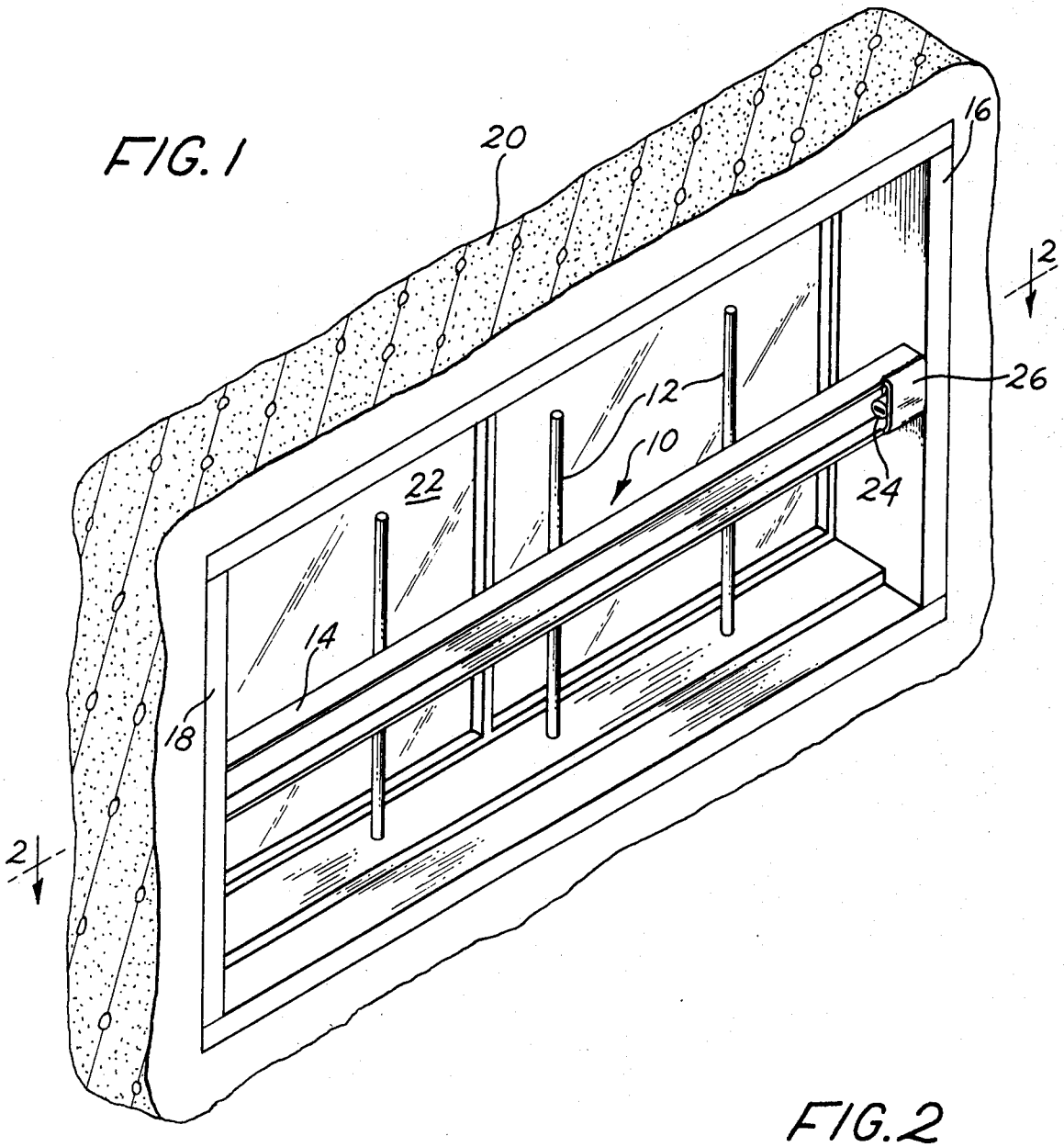
FIG. 1 is a perspective view of a window security guard constructed in accordance with the preferred embodiment of this invention as seen from the interior of the building.

Referring to FIG. 1, a window security guard is indicated generally at 10 and comprises a plurality of solid cross bars 12 rigidly mounted, such as by welding, to an elongated U-shaped or channel bar 14 generally perpendicular thereto. Channel bar 14 is secured to opposed frame or casement window buck members 16 and 18 on the interior side of the building structure 20 which houses the frame members 16 and 18. The type of window 22 illustrated is typical of a basement window assembly or buck which is often of one piece construction securely embedded in concrete.

One skilled in the art will appreciate that more than one channel bar 14 may be used to accommodate larger openings, provided the U-shaped channel or confined flanged area is oriented to face inwardly of the building structure. The placement of the guard 10 relative to window 22 is a matter of preference, and is shown in FIG. 1 as being spaced from the window 22 although the guard may also be placed immediately behind the window 22. Also, although cross bars 12 are shown mounted on the channel at right angles to the longitudinal dimension of the channel member, wrought iron filigree or other decorative metal members may alternatively be mounted in an array to the channel bars 14.

The locking mechanism shown generally at 24 is shown positioned within the confined flanged area of channel bar 14 behind cover member 26 at the right-hand end of bar 14 adjacent frame member 16.

Figure 3:
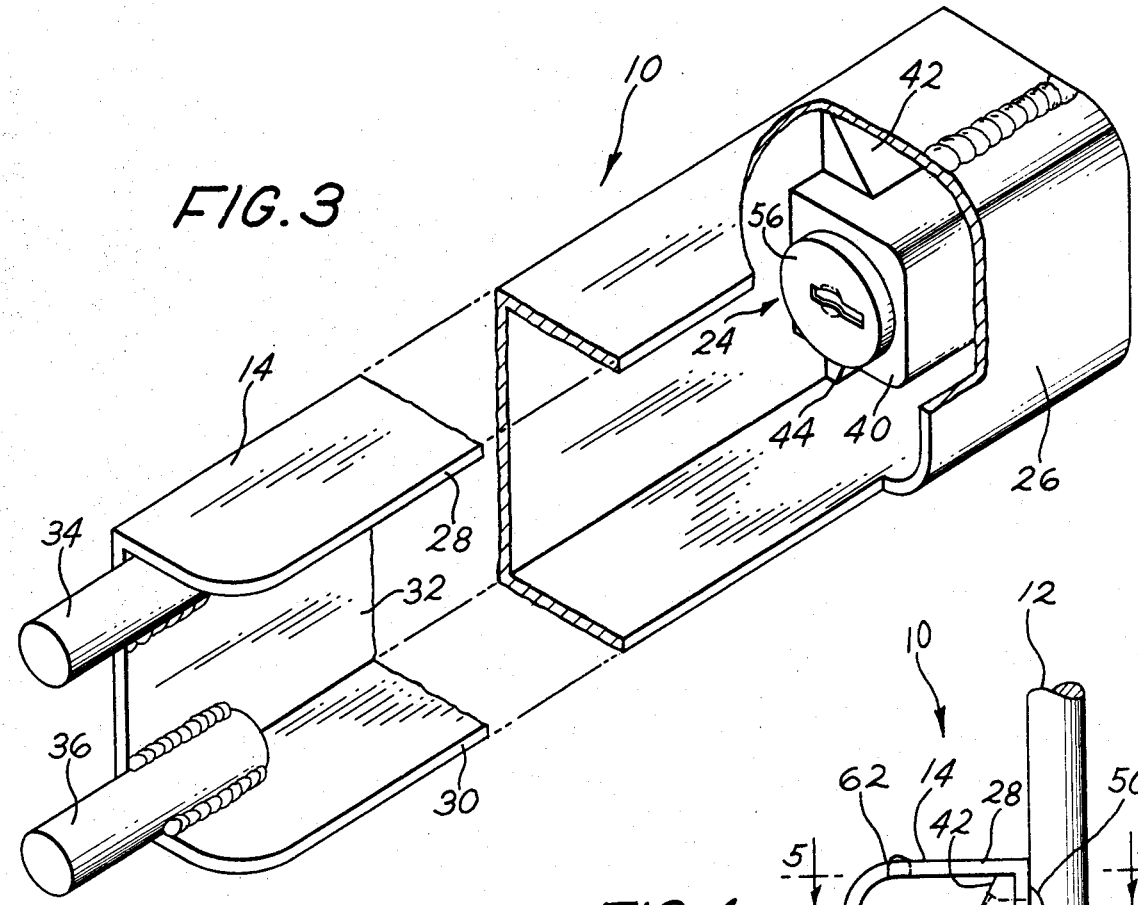
FIG. 3 is a fragmentary perspective view, partially broken away, of the window security guard of this invention.
Figure 4:
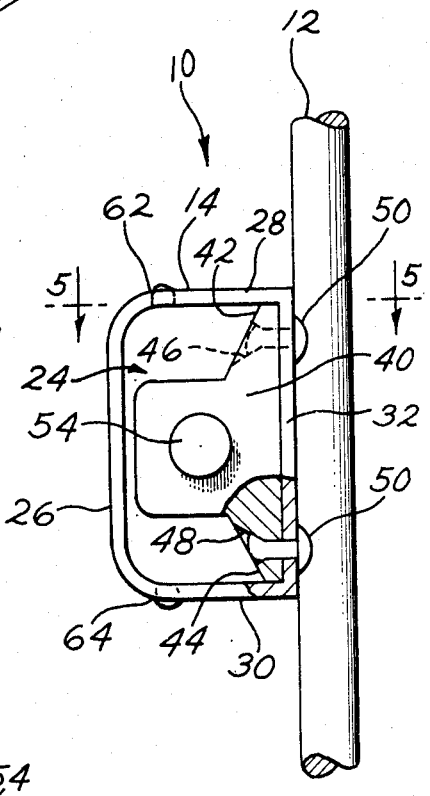
FIG. 4 is a traverse elevation, partially in section, of one end of the window security guard.

Referring to FIGS. 3 and 4, the details of bar 14 and associated mounting and locking means are illustrated. Bar 14 may be formed from rolled steel and is preferably channel-shaped, having parallel sides or flanges 28 and 30 projecting inwardly from base member 32 forming a concave or confined flanged area facing inwardly of the building. Two mounting lugs or pins 34 and 36 are securely mounted to bar 14 adjacent flanges 28 and 30 respectively. Pins 34 and 36 extend or project laterally from the terminal end of bar 14. Lock mechanism 24 may be of the barrel key-actuated type, such as the V-100 window lock manufactured by Wright Products, Inc. Main body portion 40 of lock 24 has two integral mounting shoulders 42 and 44 which in turn have holes 46 and 48 respectively, formed therein. Lock mechanism 24 is securely mounted within the confined flanged area of bar 14 to base 32 by a plurality of rivets 50 extending through holes 46 and 48 of shoulder 42 and 44 respectively and through two complementary holes drilled through base 32. Other stationary mounting means may also be employed at the end of the channel 14 opposite the lock mechanism 24. For example, a rectangular bar mating with a slot in the frame member may be employed, although it will be appreciated that the use of spaced lugs facilitates use of the guard with existing window installations due to the relative convenience of simply drilling the necessary recess holes. Also lock mechanism 24 may be welded to channel member 14 rather than being riveted.

Figure 5:
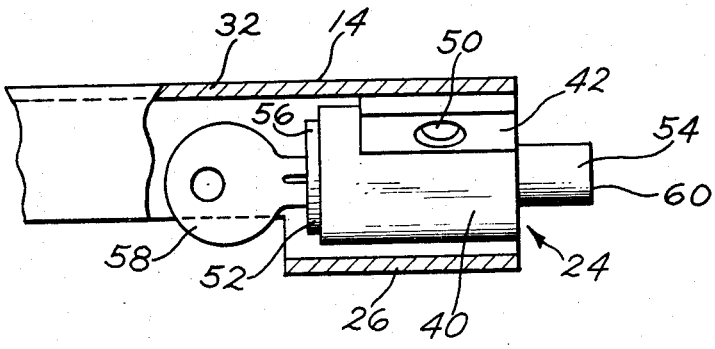
FIG. 5 is a detail fragmentary sectional view taken along line 5—5 of FIG. 4.

Referring to FIG. 5 lock mechanism 24 is shown in position with channel bar 14 in the locked mode. That is, the retractable barrel 52 has been pushed into main housing 40 which in turn forces the dead bolt 54 to extend laterally beyond the terminal end of bar 14. As can be seen, the key-receiving face 56 of the retractable barrel 52 is disposed along a plane generally parallel to the building frame member 16 (see FIG. 1) and is covered on three sides by flanges 28 and 30 and base 32 of bar 14. When key 58 is inserted into barrel 52 and rotated, barrel 52 and bolt 54 are released thereby translating laterally to the left such that the terminal end 60 of bolt 54 is withdrawn into housing 40 or so as not to extend laterally beyond said housing 40.

Referring again to FIGS. 3 and 4, lock protection plate or cover 26 is shown in detail. Cover 26 may also be formed from U-shaped rolled steel or channel iron, however, the flanges 62 and 64 are much shorter than their juxtaposed respective counterparts 28 and 30 of bar 14. As is best seen in FIG. 5, cover 26 has a lateral dimension substantially coextensive with the housing 40 of lock 24. Cover 26 is secured to channel bar 14 such as by welding where the mating flanges 28 and 62, and 30 and 46 abut, thus forming a hollow protective envelope or enclosure for lock mechanism 24. One skilled in the art will appreciate that other forms of lock covers may also be used such as a flat plate welded to flange 28 and 30 coextensive of the locking mechanism 24, or a section of pipe encircling bar 14 and fixedly secured thereto coextensive of lock 24 could be used.

Figure 2:
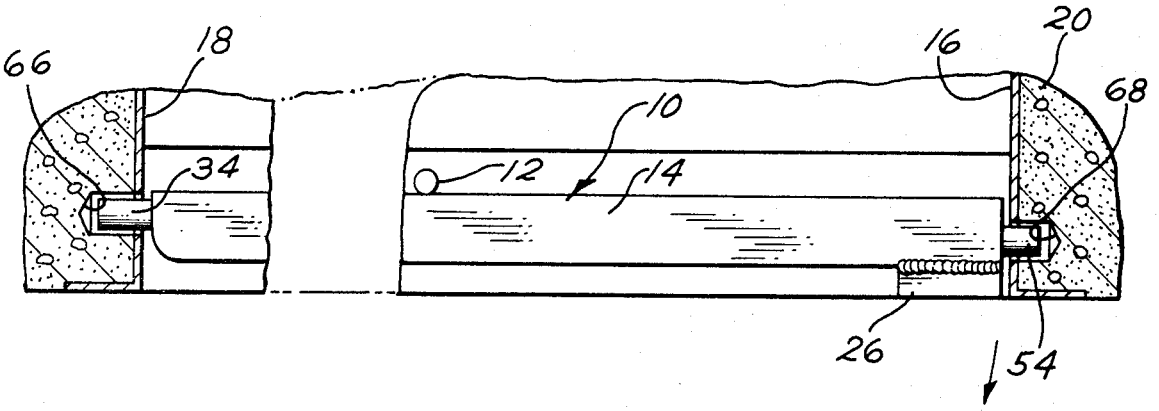
FIG. 2 is a longitudinal fragmentary sectional view taken along line 2—2 of FIG. 1.

Referring to FIG. 2, security guard 10 is shown in the mounted and locked position within the frame structure of building 20. Pins 34 and 36 (only one shown) are inserted into complementary holes or recesses 66 drilled through frame member 18 and into building 20. Cylinder or barrel 52 has been pushed into housing 40 of lock 24 (as seen in FIG. 5) so that dead bolt 54 extends into a complementary hole 68 drilled through frame member 16 and into building 20. Note that lock cover 26 completely encloses lock 24.

When it is desired to remove the guard 10 from the window opening or casement buck such as in the event of a fire or to wash the window 22, key 58 is inserted into barrel 52 of lock 24 by reaching into the confined flanged area of channel bar 14 adjacent cover 26. When the key is turned dead bolt 54 retracts from recess 68 and the guard may be removed by swinging the bar inwardly of the building as shown by the arrow in FIG. 5 thus removing pins 34 and 36 from holes 66 in the opposed frame wall.

By properly sizing pins 34 and 36, one skilled in the art will appreciate that the herein disclosed prefabricated security guard will accommodate windows having small variations in frame dimensions. Further, the spaced relationship of pins 34 and 36 prohibit any attempt to rotate the bar 14 in its mounted position which would make the lock more accessible from outside the building. It will be appreciated that alternative use of a rectangular bar in a slot recess would provide the same advantage.

A security guard for windows or the like has been disclosed which is strong and durable yet economical to manufacture, which is easily and quickly installed, even in existing installations that have no provisions for security guards, and which permits easy removal by means of a key-actuated lock while providing external protection of the lock mechanism from destruction or tampering. The construction disclosed also makes it extremely difficult to pick the lock.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A security guard for a window having opposed frame members mounted in a building structure, the guard comprising:

an elongated channel member constructed and arranged to fit within the window opening between said opposed frame members, the channel member having a confined flanged area facing inwardly of the building;

mounting means fixedly secured to and extending from one end of said channel member and adapted to engage complementary recess means formed in one of the opposed frame members;

key actuated lock means fixedly secured within said confined flanged area of said channel member at the end opposite said mounting means, said lock means having a retractable bolt adapted to extend from said opposite end of said channel member into a complementary recess formed in the other of said opposed frame members;

lock cover means fixedly secured to said channel member substantially coextensive of said lock means, said cover means constructed and arranged to envelope said lock means within said confined flanged area at said opposite end of said channel member.

2. The security guard of claim 1 wherein said lock cover means comprises a complementary channel member constructed and arranged to engage juxtaposed flanges of said elongated channel member, said complementary channel member being welded to said elongated channel member where the respective flanges engage.

3. The security guard of claim 1 wherein the key receiving face of said lock means is disposed along a plane generally parallel to the opposed frame member and is accessible within said lock cover means from said confined flanged area of said channel member adjacent said cover means.

4. The security guard of claim 1 wherein said channel member comprises a flanged bar of rolled steel shaped so that its cross section is generally U-shaped.

5. The security guard of claim 1 wherein said mounting means comprises two spaced pins welded to said channel member within said confined flanged area, said pins extending longitudinally from one end of said channel member for engagement in complementary holes formed in said frame member.

6. The security guard of claim 1 wherein said key actuated lock means is of the barrel-type, and said lock means is secured to said channel member by a plurality of rivets fastened to mounting collars formed integrally with said lock means.

7. The security guard of claim 1 further comprising a plurality of bars mounted on said channel member at right angles to the longitudinal dimension of said channel member.

* * * * *